US005304918A

United States Patent [19]

Khieu

[11] Patent Number: 5,304,918

[45] Date of Patent: Apr. 19, 1994

[54] REFERENCE CIRCUIT FOR HIGH SPEED INTEGRATED CIRCUITS

[75] Inventor: Cong Khieu, San Jose, Calif.

[73] Assignee: Samsung Semiconductor, Inc., San Jose, Calif.

[21] Appl. No.: 823,787

[22] Filed: Jan. 22, 1992

[51] Int. Cl.[5] ..... G05F 3/16

[52] U.S. Cl. ..... 323/315; 323/303; 323/907

[58] Field of Search ..... 323/312-315, 323/316, 299, 303, 907; 307/296.1, 296.6, 296.7, 296.8

[56] References Cited

U.S. PATENT DOCUMENTS

| | | | |
|---|---|---|---|
| 4,368,420 | 1/1983 | Kuo | 323/303 |
| 4,419,594 | 12/1983 | Gemmell et al. | 307/297 |
| 4,628,248 | 12/1986 | Birrittella et al. | 323/314 |
| 4,727,269 | 2/1988 | Luich | 307/530 |
| 4,894,561 | 1/1990 | Nogami | 307/443 |
| 4,902,915 | 2/1990 | Tran | 307/446 |
| 4,931,673 | 6/1990 | Naghshineh | 307/475 |
| 5,109,187 | 4/1992 | Guliani | 323/313 |
| 5,115,187 | 5/1992 | Hayashi | 323/315 |
| 5,173,656 | 12/1992 | Seevinck et al. | 323/314 |

FOREIGN PATENT DOCUMENTS 2253636 5/1973 Fed. Rep. of Germany ..... 1/58

OTHER PUBLICATIONS

IBM Technical Disclosure Bulletin. vol. 32, No. 9A, Feb. 1990, New York US pp. 425-426, XP000083128 "BI-CMOS Output Buffer Slope Control with Compensated Voltage Reference" *whole document*.

IBM Technical Disclosure Bulletin. vol. 28, No. 5, Oct. 1985, New York US pp. 2178-2180 "Self-Adjusting Stagger Circuit for Drivers".

Paper entitled "A Simple Three-Terminal IC Bandgap Reference", by A. Paul Brokaw, IEEE Jurnal of Solid-State Circuits, vol. SC-9, No. 6, Dec. 1974 pp. 388-393.

Paper entitled "A New Curvature-Corrected Bandgap Reference", by Gerard C. M. Meijer, et al, IEEE Journal of Solid-State Circuits, vol. SC-17, No. 6, Dec. 1982, pp. 1139-1143.

Paper entitled "A Novel BiCMOS TTL Input Buffer; A Merging of Analog and Digital Circuit Design Techniques", by H. V. Tran, et al., Semiconductor Process and Design Center, Texas Instruments, Inc., p. 65-66.

Paper entitled "Analysis and Design of Digital Integrated Circuits", 2nd Ed. by David A. Hodges, et al, pub. by McGraw-Hill Book Company, pp. 266-267.

Paper entitled "Anaylsis and Design of Analog Integrated Circuits", 2nd Ed. by Paul R. Gray and Robert G. Meyer, pp. 289-296.

*Primary Examiner*—Steven L. Stephan
*Assistant Examiner*—Adolf Berhane
*Attorney, Agent, or Firm*—Skjerven, Morrill, MacPherson, Franklin & Friel

[57] ABSTRACT

A reference circuit for supplying current to high speed logic elements in an integrated circuit supplies less current when circuit temperature decreases while a supply voltage remains constant. The reference circuit supplies less current when the supply voltage increases while circuit temperature remains constant. A resistance with a temperature coefficient, in some embodiments a negative temperature coefficient, is used to decrease current flow in a first leg of an output mirror when temperature decreases. A feedback circuit is used to decrease current flow in the first leg of the output current mirror when the feedback circuit senses an increase in supply voltage by sensing a voltage change on a common control node of the output current mirror. The reference circuit sees many applications including supplying current to logic gates, input/output buffers, and sense amplifiers.

24 Claims, 6 Drawing Sheets

REFERENCE CIRCUIT FOR HIGH SPEED INTEGRATED CIRCUITS

BACKGROUND OF THE INVENTION

1. Field of the Invention

This invention relates to a reference circuit. More specifically, this invention relates to a reference circuit for high speed memories which provides a greater margin for access time and noise levels over a range of temperatures and supply voltages.

2. Background Information

In order to increase the yield of low access time memories, device speeds can be increased by varying process parameters. Accordingly, the speeds of the slower memories in the yield distribution are increased and there is a higher yield of memory devices with low access times. When device speeds are increased, however, the speeds of the fastest of the memories in the yield distribution are also increased. As a result, the fastest memories become so fast that they suffer from ground bounce problems under ideal speed operating conditions. The total yield of memory devices which function over a specified operating voltage and temperature range is therefore not increased as much as desired.

The speed of CMOS and Bi-CMOS devices is fastest at high supply voltages and at low operating temperatures. Accordingly, if device speeds are increased to increase the yield of high speed CMOS and Bi-CMOS memories, the fastest CMOS and Bi-CMOS memory devices suffer from ground bounce problems when their operating supply voltages are high and when their operating temperatures are low.

To explain the operation of the present invention, the operation of one known type of a band gap reference circuit, the band gap reference circuit shown in FIG. 1, is described. The purpose of this circuit is to generate an output reference voltage $V_{REF}$, the magnitude of which does not vary with temperature. This is accomplished by generating a voltage $KV_T$ with a positive temperature coefficient and then adding that voltage to the base-emitter voltage $V_{be(on)}$ of a transistor which has a negative temperature coefficient. If the magnitude of the positive temperature coefficient voltage $KV_T$ is properly chosen, the resulting summation $V_{REF}$ of the two voltages $V_{be(on)}$ and $KV_T$ will have an overall zero temperature coefficient as shown below in equation 1.

$$V_{REF}=V_{be(on)}+KV_T \qquad \text{(Equ. 1)}$$

$V_{be(on)}$ typically has a negative temperature coefficient of approximately $-2$ mV/°C. whereas $V_T$ typically has a positive temperature coefficient of approximately 0.085 mV/°C.

The band gap circuit of FIG. 1 (Prior Art) comprises two bipolar transistors Q0 and Q1 which form a current mirror with two collector currents $I_{CQ0}$ and $I_{CQ1}$ flowing through the two transistors Q0 and Q1, respectively. The base of transistor Q0, the base of transistor Q1, and the collector of transistor Q1 are connected together at node N1. The emitter of transistor Q1 is tied directly to ground, whereas the emitter of transistor Q0 is tied to ground through a resistor R6. Due to the inclusion of resistor R1 between the emitter of transistor Q0 at node N5 and ground, the proportion of current passing through transistor Q0 can be chosen to be any fraction of the current passing through transistor Q1. The voltage present across the base emitter junction of transistor Q0 is always related to, yet always smaller than, the voltage present across the base emitter junction of transistor Q1.

Similarly, the relative sizes of Q1 and Q0 can be varied so that Q0 conducts more current at a given base-emitter voltage than Q1 conducts at the same base-emitter voltage. Current $I_{CQ0}$ can therefore be chosen to be larger than, equal to, or smaller than current $I_{CQ1}$ as long as variations in current $I_{CQ1}$ affect corresponding changes in current $I_{CQ0}$.

Assuming, for the time being, that a constant temperature independent voltage exists at node N0. The voltage dropped across resistor R2 increases with temperature because the voltage $V_{be}$ across the base-emitter junction of the diode-connected transistor Q1 decreases with temperature. With a larger voltage dropped across R2 as temperature increases, a larger current $I_{R2}$ flows across resistor R2 as temperature increases. Resistor R4 is provided between Vcc and node N4 to bias node N4 initially so that the base-emitter junctions of transistors Q2 and Q3 will be forward biased thereby causing the circuit to reach a stable operating point. Additional details of such a band-gap reference voltage supply circuit are given in *Analysis and Design of Analog Integrated Circuits* (second ed. 1984) by Paul Gray and Robert Meyer, pages 289–296.

The current $I_{CQ0}$ flowing into the collector of transistor Q0 will be the mirror of current $I_{R2}$ and therefore must also have a positive temperature coefficient. Assuming that a negligible amount of current flows into the base of the transistor Q4, current $I_{CQ0}$ is converted into a voltage with a positive temperature coefficient by running current $I_{CQ0}$ through a resistor R3. One end of resistor R3 is connected to the collector of transistor Q0 at a node N2. The other end of resistor R3 is connected to a node N3. The resistance of resistor R3 is therefore seen to influence the magnitude of the constant K in the voltage $KV_T$. This voltage has a positive temperature coefficient across resistor R3.

To add a negative temperature coefficient voltage to the positive temperature coefficient voltage across resistor R3, the base of bipolar transistor Q4 is connected to node N2 and the emitter of bipolar transistor Q4 is connected to ground. Accordingly, the base-emitter voltage $V_{be(on)}$ of transistor Q4 will be present between ground and node N2. The voltage at node N3 therefore is the sum of the negative temperature coefficient voltage $V_{be(on)}$ from ground to node N2 and the positive temperature coefficient voltage $KV_T$ across resistor R3. By properly choosing the magnitude of resistor R3, the magnitude of the positive temperature coefficient voltage drop across resistor R3 can be chosen to cancel exactly the negative temperature coefficient of $V_{be(on)}$ of transistor Q4. The bandgap reference voltage output $V_{REF}$ of the circuit of FIG. 1 is therefore present between node N3 and ground.

This conclusion is, however, premised on the voltage N0 being a constant temperature independent voltage. By connecting the emitter of a transistor Q2 to node N0, by connecting the base of transistor Q2 to the base of a transistor Q3, by connecting the emitter of transistor Q3 to the temperature compensated node N3, and by connecting the collectors of transistors Q2 and Q3 to Vcc, node N4 is biased at one base-emitter drop above the voltage on node N3 so that the voltage on node N0 is biased at one base-emitter voltage drop below the voltage on node N4. The result is that node N0 is supplied with temperature independent voltage on node N3 as previously assumed.

If the bandgap reference circuit of FIG. 1 were used to supply current to a CMOS or Bi-CMOS memory, the reference circuit would output a constant current as the circuit temperature decreased. The CMOS or Bi-CMOS memory circuitry would therefore become faster and the fastest memories in the yield distribution may suffer from ground bounce problems.

SUMMARY OF THE INVENTION

It is an object of the present invention to produce a reference circuit which inhibits the propensity of memory circuits to speed up under conditions of high supply voltages and/or low temperatures. The reference circuit conventionally used to supply current to high speed memories, the band gap reference, supplies a substantially constant current regardless of variations in power supply voltage and/or temperature.

The present invention, on the other hand, replaces the conventional band gap reference with a circuit that actually reduces the amount of current supplied to the memory under high voltage conditions and/or low temperature conditions. Accordingly, the increase in the amount of current that a fast memory sinks or sources in a given amount of time under high voltage and/or low temperature conditions is reduced. As a result, the amount of time required for the fast CMOS or Bi-CMOS device to discharge a given capacitance on a node so that the voltage on the node transitions logic levels is not shortened when the CMOS or Bi-CMOS device experiences high voltage and/or low temperature conditions. The ground bounce problems of those CMOS and Bi-CMOS memories which are on the fast end of the yield distribution curve will therefore not be exacerbated at ideal operating conditions when device speeds of all the devices in the yield distribution curve are increased.

DETAILED DESCRIPTION OF THE EMBODIMENTS

Figure 1:
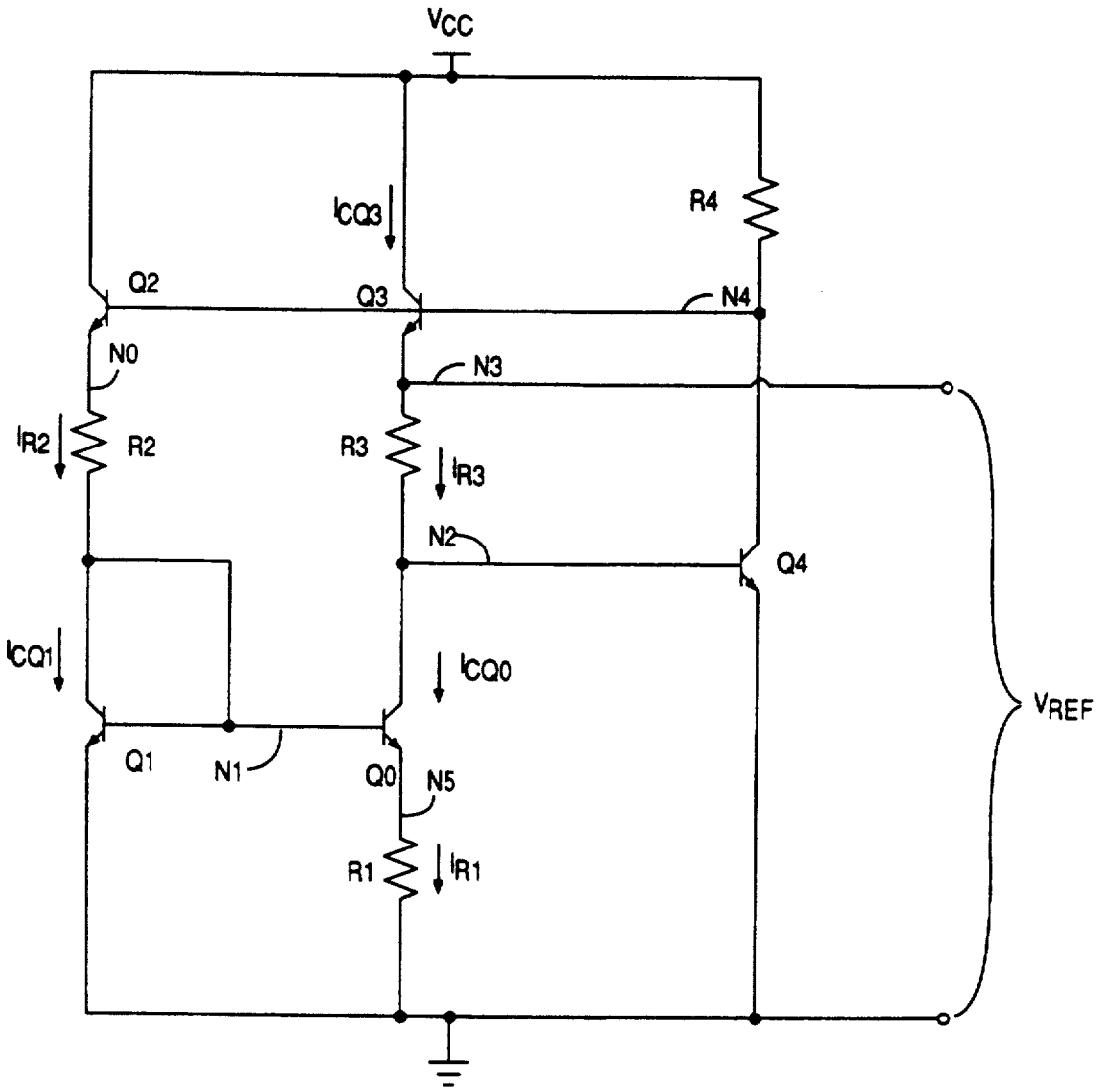
Fig. 1 (PRIOR ART)
FIG. 1 (PRIOR ART) is a circuit diagram of a conventional band gap reference circuit.
Figure 2:
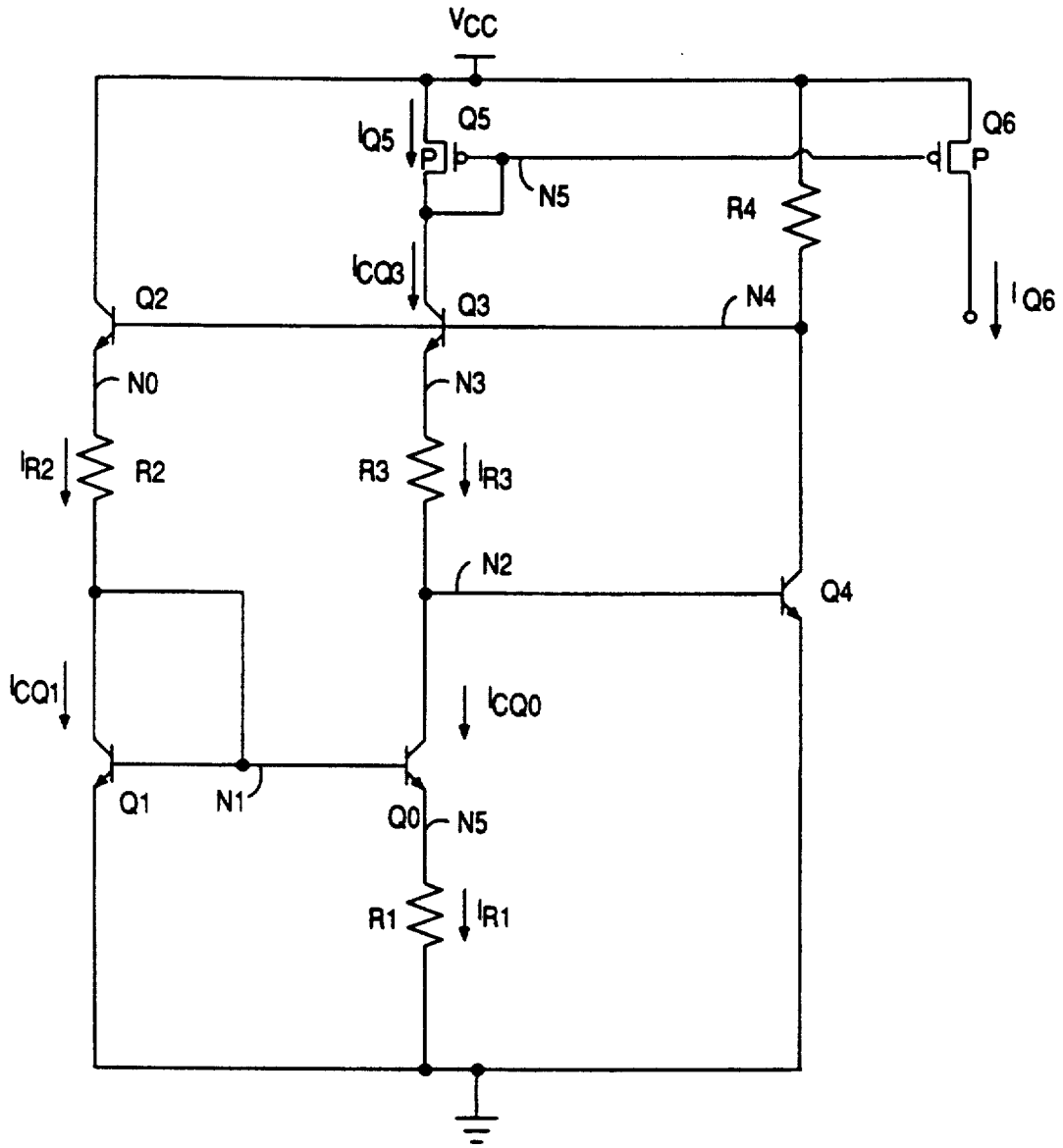
FIG. 2 is a circuit diagram of a reference circuit having an output current mirror.

FIG. 2 is a circuit diagram of the reference circuit of FIG. 1 with an additional output current mirror. Because the voltage on node N3 is stable over a range of temperatures, the current $I_{CQ3}$ will also be fairly stable over temperature. A current mirror comprising a P channel field effect transistor Q5 and a P channel field effect transistor Q6 is used to mirror the current $I_{CQ3}$ to an output current $I_{Q6}$. In this current mirror, the sources of transistors Q5 and Q6 are connected to Vcc. The gates of transistors Q5 and Q6 are tied together and to the collector of transistor Q3. The drain of transistor Q5 is connected to the collector of transistor Q3. The drain of transistor Q6 then provides the output current $I_{Q6}$ from the reference circuit. Transistors Q5 and Q6 are both the same type of transistor, P channel field effect transistors, so that changes in temperature will affect them both in the same way.

Figure 3:
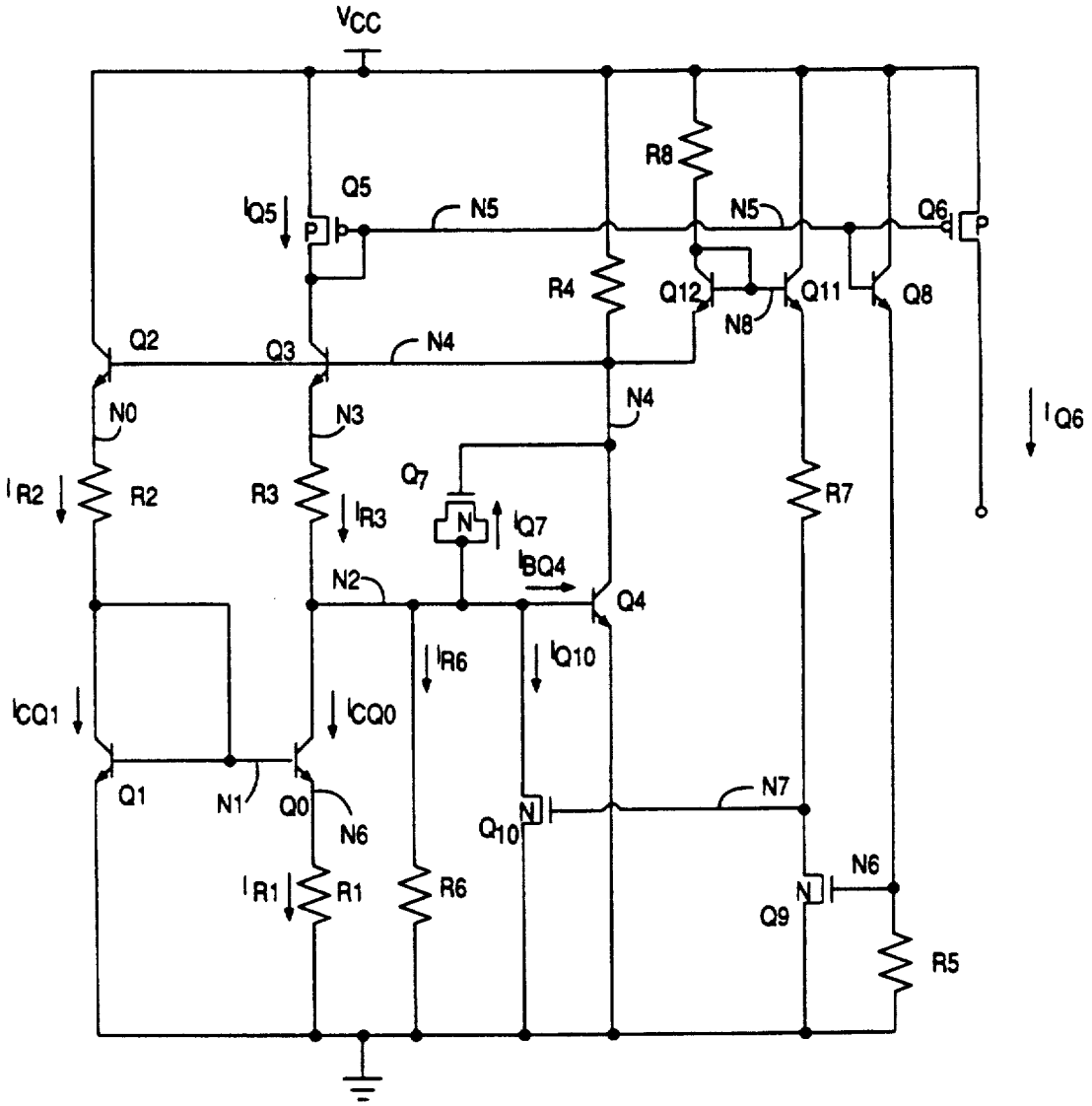
FIG. 3 is a circuit diagram of one embodiment of the reference circuit of the present invention.

FIG. 3 is a drawing of a reference circuit of the present invention. Bipolar transistors Q0 and Q1 form a current mirror. The bases of transistors Q0 and Q1 are tied together at node N1. The emitter of transistor Q1 is tied directly to ground and the emitter of transistor Q0 is tied to ground through resistance R1. The base of transistor Q1 is tied to the collector of transistor Q1. A resistance R3 is tied between node N2 at the collector of transistor Q0 and a node N3 at the emitter of a bipolar transistor Q3. The collector of transistor Q3 is tied to a node N5. The base of transistor Q3 is tied to a node N4. Node N4 is also tied to the base of a bipolar transistor Q2. The emitter of transistor Q2 is connected via a resistance R2 to the collector of transistor Q1 at node N1. The collector of transistor Q2 is tied directly to Vcc. The base of a bipolar transistor Q4 is tied to node N2, the emitter of transistor Q4 is tied directly to ground, and the collector of transistor Q4 is tied to node N4. A resistance R4 is connected between Vcc and node N4. An N channel field effect transistor Q7 is connected as a capacitor between nodes N4 and N2, the source and drain of transistor Q7 being connected to node N2 and the gate of transistor Q7 being connected to node N4.

The drain and gate of a P channel field effect transistor Q5 are commonly connected to the collector of transistor Q3 at node N5. The source of transistor Q5 is tied to Vcc. A gate of a current mirroring P channel field effect transistor Q6 is also connected to node N5. The source of transistor Q6 is connected to Vcc and the drain of transistor Q6 outputs the output current $I_{Q6}$ of the reference circuit.

A gate of a bipolar transistor Q8 is connected to node N5. The collector of transistor Q8 is connected to Vcc and the emitter of transistor Q8 is connected to a node N6. A resistance R5 is connected between node N6 and ground. A gate of an N channel transistor Q9 is connected to node N6. The source of transistor Q9 is connected to ground and the drain transistor Q9 is connected to a node N7. Node N7 is connected to the gate of an N channel MOS transistor Q10, the source of which is connected to ground and the drain of which is connected to node N2. A resistance R6 connected between node N2 and ground.

One end of a resistance R7 is connected to node N7. The other end of resistance R7 is connected to the emitter of a bipolar transistor Q11. The base of transistor Q11 is tied to a node N8 and the collector of transistor Q11 is tied to Vcc. The base and collector of another bipolar transistor, transistor Q12, are commonly connected to node N8. A resistance R8 is connected between node N8 and Vcc. The emitter of transistor Q12 is connected to node N4.

Figure 4:
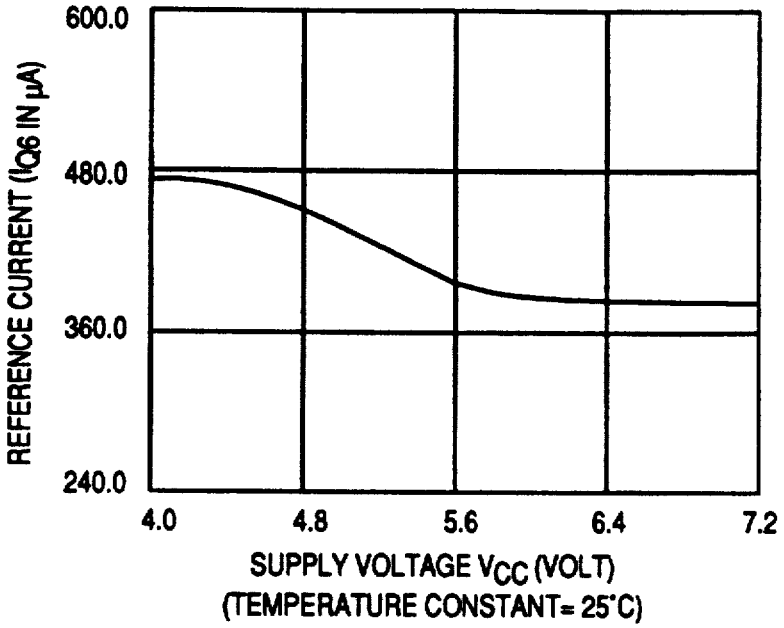
FIG. 4 is a graph showing the variation in output supply current when the supply voltage of the reference circuit of the present invention is varied.

FIG. 4 is a graph showing how the output current $I_{Q6}$ output from the reference circuit of FIG. 3 decreases when the supply voltage Vcc of the circuit increases from 4.0 volts to 7.2 volts. As Vcc increases in the circuit of FIG. 3, the voltage of node N5 is observed to increase and substantially track Vcc so that the voltage between node N5 and Vcc remains substantially constant. This characteristic of the voltage on node N5 is used to reduce the magnitude of current $I_{R3}$ and thereby to reduce the currents $I_{Q5}$ and $I_{Q6}$. As the voltage on node N5 increases with increasing Vcc, transistor Q8 conducts more current, the voltage on node N6 increases, transistor Q9 conducts more current, the voltage on node N7 decreases and transistor Q10 conducts less current. Because $I_{Q10}$ is a component of current $I_{R3}$, reducing $I_{Q10}$ serves to reduce $I_{R3}$. By controlling the gain of this feedback circuitry, the magnitude of the decrease in current $I_{R3}$ with increasing supply voltage Vcc is controlled. The result is the desired decrease in output reference current $I_{Q6}$ with increasing supply voltage $V_{CC}$ as shown in FIG. 4. In the feedback circuit of FIG. 3, transistors Q11 and Q12 as well as resistors R7 and R8 are configured as a current source load for the amplifier feedback stage including N channel transistor Q9.

Figure 5:
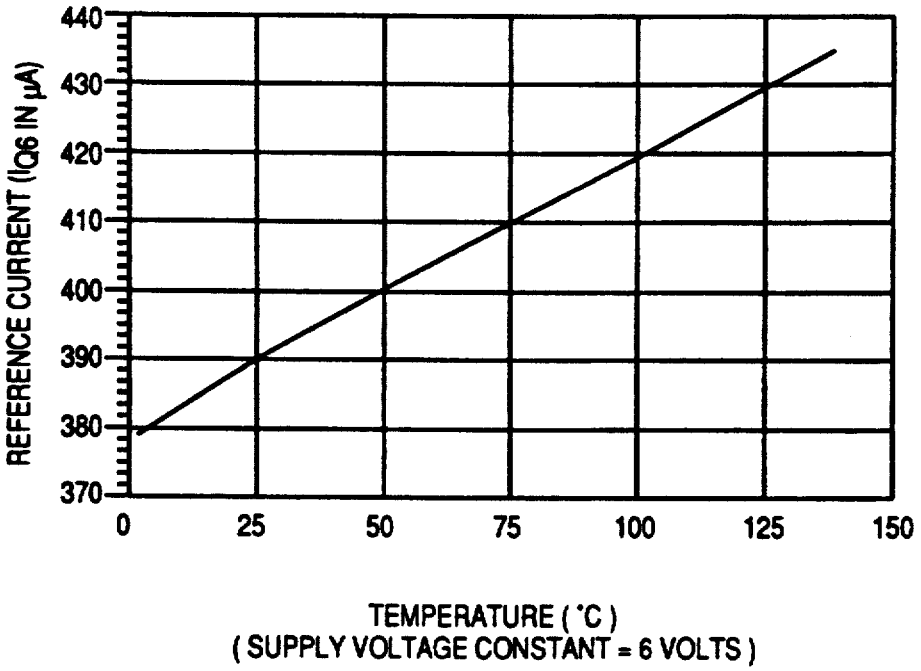
FIG. 5 is a graph showing the variation in output supply current when the temperature of the reference circuit of the present invention is varied.

FIG. 5 is a graph showing how the output reference current $I_{Q6}$ output by the reference circuit of FIG. 3 increases as the operating temperature of the circuit increases from 0° C. to 150° C. The assumption made above in the discussion of FIG. 1 that $V_{ref}=-V_{be(on)}+KV_T$, was premised on resistance R1 having a resistance that does not change substantially with temperature. At a given temperature, if the resistance of R1 were to change, the base-emitter voltage $V_{be}$ across transistor Q0 would be affected and the current $I_{R3}$ would be changed. If resistor R1 were to decrease, for example, a larger base-emitter voltage would initially be present across transistor Q0 because the voltage of node N1 is the sum of the $V_{be}$ of transistor Q0 and the voltage dropped across resistor R1. This larger base-emitter voltage would cause transistor Q0 to conduct more current and would cause current $I_{R3}$ to increase. Similarly, if resistor R1 were to increase, the base-emitter voltage of transistor Q0 would initially decrease, the current conducted by transistor Q0 would decrease, and current $I_{R3}$ would decrease.

Standard diffusion resistors are typically implemented in CMOS and Bi-CMOS integrated circuit processes. These resistors have resistances that increase with increasing temperature. Accordingly, if such typical resistors would be used in the circuit of FIG. 3, increased circuit temperatures would result in larger values of resistance R1 and a smaller current $I_{R3}$. The present invention therefore uses a resistor with a negative temperature coefficient such as a thin film resistor, for resistance R1. This may be, for example, a high sheet ρ polysilicon thin film resistor. Such a resistor has a resistance which decreases with increasing temperature. Accordingly, the present invention achieves the desired increase in output reference current $I_{Q6}$ when the temperature of the circuit increases.

It is to be understood that the present invention involves using resistances with non-zero temperature coefficients to decrease reference current output at low circuit temperatures. In some embodiments, this may involve using a positive temperature coefficient resistor at a location in a reference circuit which would actually result in a decrease in the output reference current as circuit temperature decreases. The teaching of the present invention is therefore not limited to using negative temperature coefficient resistors to adjust the output reference current.

Figure 6:
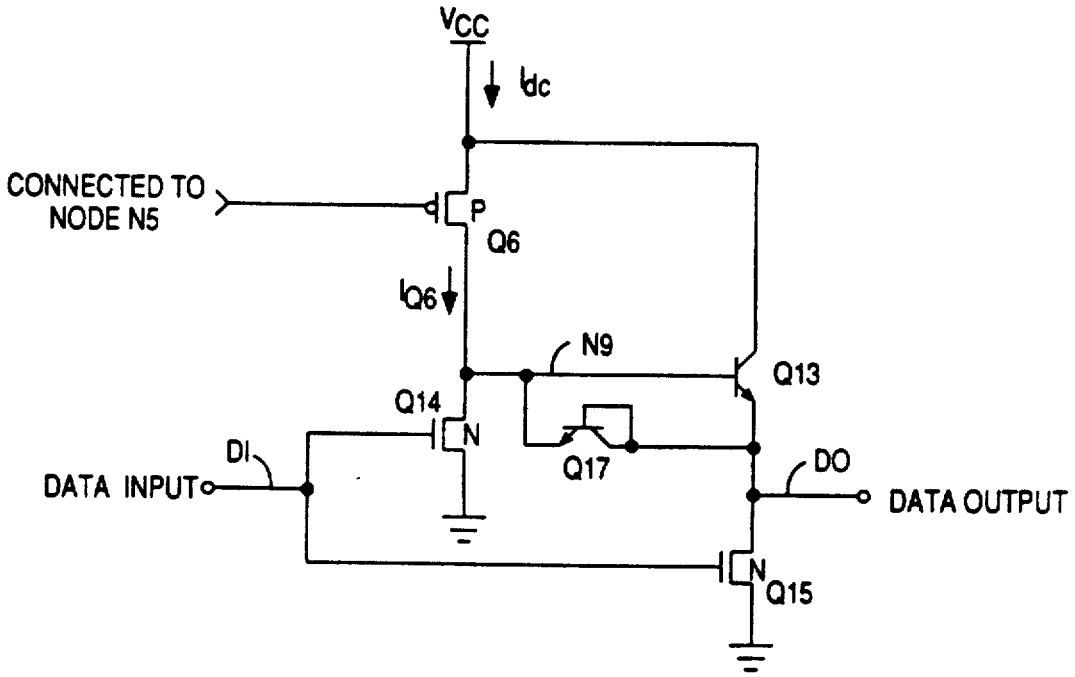
FIG. 6 shows the reference circuit of the present invention being used to supply current to a Bi-CMOS input buffer circuit.

FIG. 6 shows one possible application of one embodiment of the reference circuit of the present invention. The circuitry of FIG. 3 is used in FIG. 6 to supply current to a Bi-CMOS non-inverting input buffer circuit. Transistor Q6 of FIG. 6 is transistor Q6 of the reference circuit of FIG. 3. The source of transistor Q6 is connected to Vcc and the drain of transistor Q6 is connected to node N9 of the circuit of FIG. 3. A base of a bipolar transistor Q13 is connected to node N9 and the emitter of transistor Q13 is connected to a data output terminal DO. The gate of a N channel field effect transistor Q14 is connected to a data input terminal DI. The drain of transistor Q14 is connected to node N9 and the source of transistor Q14 is connected to ground. The gate of a second N channel field effect transistor Q15 is connected to a the data input terminal DI, the drain of transistor Q15 is connected to the data output terminal DO, and the source of transistor Q15 is connected to ground. The collector and base of a second diode-connected bipolar transistor Q17 are connected to the data output terminal DO and the emitter of transistor Q17 is connected to node N9.

When data input terminal DI transitions low to high, transistors Q14 and Q15 are turned on. As a result, the voltage on node N9 is pulled down to ground and bipolar transistor Q13 is turned off. With transistor Q13 being off and transistor Q15 being on, the voltage on the output data terminal DO is low.

When data input terminal DI transitions high to low, transistors Q14 and Q15 are turned off. The voltage of node N9 is therefore pulled up toward $V_{CC}$ through transistor Q6 and transistor Q13 is turned on. Transistor Q17 is reverse biased and therefore does not affect the increase in voltage on the base of transistor Q13. Because transistor Q13 is turned on and transistor Q15 is turned off, the voltage on the data output terminal DO increases. Diode-connected transistor Q17 ensures that the voltage on the data output terminal DO will not rise more than one diode drop above the voltage on node N9.

TABLE 1 compares the performance of the input buffer of FIG. 6 being supplied current from a conventional band gap reference to the performance of the input buffer of FIG. 6 being supplied current from the reference circuit of FIG. 3 of the present invention.

TABLE 1

| | Input Buffer with Conventional Bandgap Reference Circuit | Input Buffer with Reference Circuit of FIG. 3 | Comment |
|---|---|---|---|
| $I_{dc(max)}$ | 569 μA | 481 μA | Maximum DC current of Input Buffer of FIG. 6 |
| Δ trip point | 0.45 V | 0.25 V | Variation in input trip point of buffer of FIG. 6 |
| delay at 4.2 V and 140° C. | 2.88 nm | 2.5 nm | Delay of input buffer of FIG. 6, one latch, one CMOS inverter, and Bi-CMOS gate. |

The testing conditions for the trip point were varied from 4.2 volts and 140° C. to 6.0 volts and 0° C. The Δ trip point in the above table includes the metastable state range. Typically, one input buffer consumes about 0.569 mA and has a delay of 2.88 ns. With the new reference circuit, the input buffer is 380 ps faster, the trip point is 45% better controlled, and the power consumption is reduced to only 0.481 mA.

Figure 7:
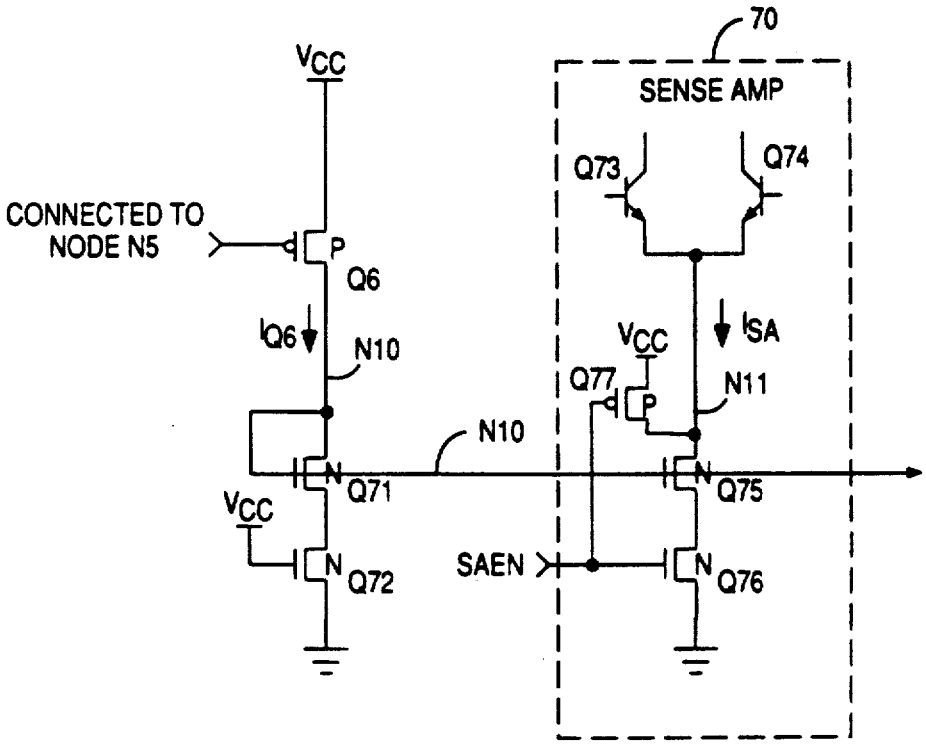
FIG. 7 shows the reference circuit of the present invention being used to supply current to a sense amplifier.

FIG. 7 shows a second application of one embodiment of the reference circuit of the present invention. The circuitry of FIG. 3 is used in FIG. 7 to supply current to a sense amplifier 70 of an integrated circuit memory. Transistor Q6 of FIG. 6 is transistor Q6 of the reference circuit of FIG. 7. In FIG. 7, the source of transistor Q6 is connected to both the drain and the gate of an N channel transistor Q71 at node N10. The source of transistor Q71 is connected to the source of a resistive N channel transistor Q72. The gate of transistor Q72 is tied to $V_{CC}$ whereas the source of transistor Q72 is tied to ground. The width to length ratios of transistors Q71 and Q72 may be chosen to set the current $I_{Q6}$ to a predetermined desired value.

Sense amplifier 70 may comprise an emitter coupled pair such as is formed by NPN bipolar transistors Q73 and Q74. The emitter of transistors Q73 and Q74 are tied together at node N11. The drain of an N channel transistor Q75 is connected to node N11 and the gate of transistor Q75 is connected to node N10. The source of transistor Q75 is connected to the drain of another N channel transistor Q76. The source of transistor Q76 is connected to ground. A sense amplifier enable signal SAEN is supplied to the gate of transistor Q76 as well as to the gate of a P channel transistor Q77. The source of transistor Q77 is tied to VCC whereas the drain is connected to node N11.

The width to length ratios, and the series on resistances of transistors Q75 and Q76 are matched with the width to length ratios and series on resistances of transistors Q71 and Q72. Accordingly, when the sense amplifier 70 is turned on by input signal SAEN going high to a CMOS high level, the sense amplifier current $I_{SA}$ is substantially the same as current $I_{Q6}$ output from the reference circuit. These currents are substantially identical because matched transistors Q71 and Q75 are both controlled by the same gate voltage on node N10 and because matched transistors Q72 and Q76 are both turned on by substantially identical high voltages on $V_{CC}$ and the SAEN input, respectively. Transistor Q77 is provided to prevent node N11 of the sense amplifier from floating when transistor Q76 is turned off. In the condition that SAEN goes low to turn sense amplifier 70 and transistor Q76 off, the gate of P channel transistor also goes low. Transistor Q77 therefore turns on to maintain node N11 high at $V_{CC}$. In some embodiments, multiple sense amplifiers such as sense amplifier 70 may be incorporated. In these embodiments, node N10 can be supplied to transistors of other sense amplifiers which correspond to transistor Q75 of the depicted sense amplifier 70.

Although specific embodiments of the present invention are described in the foregoing disclosure, it is evident that multiple adaptations to other semiconductor technologies and to supplying current to other circuitry will be apparent to those skilled in the art. Accordingly, this description is to be construed as illustrative only and is for the purpose of teaching one manner of carrying out the invention. Specifics of the embodiments described above are therefore not intended to limit the true scope of the invention as set forth in the appended claims.

I claim:

1. A reference circuit, comprising:

means for supplying an output current, said means for supplying comprising a first current mirror having a first current path and a second current path, a first current flowing in said first current path, said output current flowing in said second current path, a magnitude of said first current being related to a magnitude of said output current;

means for increasing said magnitude of said first current when a temperature increases, said means for increasing comprising a second current mirror; and means for decreasing said magnitude of said first current when a supply voltage increases.

2. The reference circuit of claim 1, wherein said first current mirror comprises two field effect transistors, and wherein said second current mirror comprises two bipolar transistors.

3. The reference circuit of claim 2, wherein said means for increasing comprises a band gap reference circuit.

4. The reference circuit of claim 1, wherein aid means for increasing comprises a first transistor, a second transistor, a third transistor, a first impedance element, and a second impedance element, a base of said first transistor being coupled to a base of said second transistor, said base of said second transistor being coupled to a collector of said second transistor, said first impedance element being coupled between an emitter of said first transistor and an emitter of said second transistor, a base of said third transistor being coupled to a collector of said first transistor, said first impedance element being coupled between said emitter of said third transistor and an emitter of said first transistor, said second impedance element being coupled to a base of said third transistor.

5. The reference circuit of claim 1, wherein said means for increasing comprises an impedance element having a negative temperature coefficient.

6. The reference circuit of claim 1, wherein said first current mirror comprising two transistors, each of said two transistors of said first current mirror having a control electrode, said control electrodes of said first current mirror being coupled together, and wherein said means for decreasing comprises a circuit for controlling a shunt current depending on a magnitude of a voltage on the control electrodes of said two transistors of said first current mirror.

7. The reference circuit of claim 6, wherein said means for increasing comprises a reference current path, a reference current flowing in said reference current path, said first current said reference current and said shunt current each having magnitudes, said magnitude of said first current being at least as great as the sum of said magnitudes of said reference current and said shunt current.

8. The reference circuit of claim 4, wherein said first impedance element is a thin film resistor having a negative temperature coefficient.

9. A reference circuit, comprising:

means for supplying an output current, said means for supplying comprising a first current path and a second current path, a first current flowing in said first current path, said output current flowing in said second current path, a magnitude of said first current being related to a magnitude of said output current, said means for supplying comprising a first transistor and a second transistor, a control electrode of said first transistor being coupled to a control electrode of said second transistor;

means for increasing said magnitude of said first current when a temperature increases, said means for increasing comprising a first transistor, a second transistor, a third transistor, a first temperature sensitive impedance element, and a second impedance element, a base of said first transistor being coupled to a base of said second transistor, said base of said second transistor being coupled to a collector of said second transistor, said first temperature sensitive impedance element being coupled between an emitter of said first transistor and an emitter of said second transistor, a base of said third transistor being coupled to a collector of said first transistor, said first temperature sensitive impedance element being coupled between said emitter of said third transistor and an emitter of said first transistor, said second impedance element being coupled to a base of said third transistor; and means for decreasing said magnitude of said first current when a supply voltage increases, said means for decreasing comprising a means for conducting current, a first terminal of said means for conducting being connected to said base of said third transistor of said means for increasing, a second terminal of said means for conducting being connected to said emitter of said third transistor of said means for increasing, a third control terminal of said means for conducting being connected to said control electrode of said second transistor of said means for supplying.

10. A method of controlling an output current, comprising the steps of:

using a temperature sensitive impedance element to increase a magnitude of said output current when a temperature increases and when a voltage of a voltage supply is constant; and using a feedback circuit to decrease said magnitude of said output current when said voltage of said voltage supply increases and when said temperature is constant, said feedback circuit detecting a voltage present on the control electrodes of two transistors, said two transistors forming a current mirror.

11. The method of claim 10, wherein temperature sensitive impedance element is a thin film resistor.

12. The method of claim 10, wherein said two transistors of said feedback circuit are field effect transistors.

13. A circuit comprising:

a Bi-CMOS buffer stage having a reference current input, a data input, and a data output; and means for generating a reference current, said means for generating having an output which is connected to said reference current input of said Bi-CMOS buffer, said reference current having a magnitude which increases when a temperature increases and while a supply voltage is constant, said reference current having a magnitude which decreases when said supply voltage increases while said temperature is constant.

14. The circuit of claim 13, wherein said Bi-CMOS buffer stage comprises a first transistor, a second transistor, and a third transistor, a control electrode of said first transistor being coupled to said reference current of said Bi-CMOS buffer and to a first electrode of said second transistor, a control electrode of said second transistor being coupled to a control electrode of said third transistor and to said data input of said Bi-CMOS buffer stage, a first electrode of said third transistor being coupled to a third electrode of said first transistor and to said data output of said Bi-CMOS buffer stage.

15. The circuit of claim 14, further comprising a fourth transistor, a control electrode of said fourth transistor and a first electrode of said fourth transistor being coupled to said output of said Bi-CMOS buffer stage, a second electrode of said fourth transistor being coupled to said control electrode of said first transistor.

16. The circuit of claim 14, wherein said first transistor is a NPN bipolar transistor, and wherein said second and third transistors are N channel field effect transistors.

17. A circuit, comprising:

a reference circuit, comprising:

means for supplying an output current, said means for supplying comprising a first current mirror having a first current path and a second current path, a first current flowing in said first current path, said output current flowing in said second current path, a magnitude of said first current being related to a magnitude of said output current;

means for increasing said magnitude of said first current when a temperature increases, said means for increasing comprising a second current mirror; and means for decreasing said magnitude of said first current when a supply voltage increases; and a logic element taken from the group consisting of: an input buffer, an output buffer, a NAND gate, an AND gate, a NOR gate, an OR gate, and an inverter, said logic element having a reference current input, said output current of said reference circuit being supplied to said reference current input of said logic element.

18. The circuit of claim 17, wherein said logic element is a CMOS logic element.

19. The circuit of claim 17, wherein said logic element is a Bi-CMOS logic element.

20. A circuit, comprising a reference circuit, a load, and a sense amplifier:

said reference circuit comprising:

means for supplying a reference current from a reference current output terminal, said means for supplying comprising a first current path and a second current path, a first current flowing in said first current path, said reference current flowing in said second current path, a magnitude of said first current being related to a magnitude of said reference current;

means for increasing said magnitude of said first current when a temperature increases; and means for decreasing said magnitude of said first current when a supply voltage increases;

said load comprising a field effect transistor having a first terminal, a second terminal, and a gate, said first terminal of said load being coupled to said reference current output terminal of said reference circuit; and said sense amplifier, comprising:

an emitter coupled pair; and a field effect transistor having a first terminal, a second terminal, and a gate, said gate of said field effect transistor of said sense amplifier being coupled to said gate of said field effect transistor of said load, said first terminal of said field effect transistor of said sense amplifier being coupled to said emitter coupled pair.

21. The circuit of claim 20, wherein said load further comprises first means for resisting current flow, said first means for resisting being connected between ground and said second terminal of said field effect transistor of said load, and wherein said sense amplifier further comprises a second means for resisting current flow, said second means for resisting being connected between ground and said second terminal of said field effect transistor of said sense amplifier.

22. The circuit of claim 21, wherein said first means for resisting comprises a field effect transistor, said field effect transistor of said first means for resisting having a gate which is coupled to a supply voltage.

23. The circuit of claim 22, wherein said second means for resisting comprises a field effect transistor, said field effect transistor of said second means for resisting having a gate which receives a sense amplifier enable signal.

24. The circuit of claim 20, wherein said field effect transistor of said load has a width to length ratio which is substantially matched to a width to length ratio of said field effect transistor of said sense amplifier.

* * * * *

UNITED STATES PATENT AND TRADEMARK OFFICE

CERTIFICATE OF CORRECTION

PATENT NO. : 5,304,918

DATED : April 19, 1994

INVENTOR(S) : Cong Khieu

It is certified that error appears in the above-identified patent and that said Letters Patent is hereby corrected as shown below:

Column 6, Table 1: "2.88nm" and "2.5nm" should read --2.88ns-- and --2.5ns--

Column 8, line 20, claim 4: delete "aid" and insert --said--

Signed and Sealed this

Fourteenth Day of March, 1995

*Attest:*

*Attesting Officer*

BRUCE LEHMAN

*Commissioner of Patents and Trademarks*